US008327928B2

(12) United States Patent
Angelle et al.

(10) Patent No.: US 8,327,928 B2
(45) Date of Patent: Dec. 11, 2012

(54) EXTERNAL GRIP TUBULAR RUNNING TOOL

(75) Inventors: Jeremy R. Angelle, Lafayette, LA (US); Donald E. Mosing, Lafayette, LA (US); Robert L. Thibodeaux, Jr., Lafayette, LA (US)

(73) Assignee: Frank's Casing Crew and Rental Tools, Inc., Lafayette, LA (US)

( * ) Notice: Subject to any disclaimer, the term of this patent is extended or adjusted under 35 U.S.C. 154(b) by 431 days.

(21) Appl. No.: 12/604,327

(22) Filed: Oct. 22, 2009

(65) Prior Publication Data

US 2010/0101805 A1 Apr. 29, 2010

Related U.S. Application Data

(63) Continuation-in-part of application No. 12/126,072, filed on May 23, 2008, now Pat. No. 7,992,634, which is a continuation-in-part of application No. 11/846,169, filed on Aug. 28, 2007, now Pat. No. 7,997,333.

(60) Provisional application No. 61/107,565, filed on Oct. 22, 2008.

(51) Int. Cl.
*E21B 19/07* (2006.01)

(52) U.S. Cl. ..... 166/77.52; 166/75.14

(58) Field of Classification Search ..... 175/85, 175/113, 122, 162, 195, 203; 166/77.1, 77.52, 166/75.14
See application file for complete search history.

(56) References Cited

U.S. PATENT DOCUMENTS

| | | | | |
|---|---|---|---|---|
| 2,998,084 | A * | 8/1961 | Johnson et al. | 175/85 |
| 3,191,450 | A * | 6/1965 | Wilson | 474/88 |
| 3,623,558 | A * | 11/1971 | Brown | 173/17 |
| 3,722,603 | A | 3/1973 | Brown | |
| 4,100,968 | A | 7/1978 | Delano | |
| 4,489,794 | A | 12/1984 | Boyadjieff | |
| 4,605,077 | A | 8/1986 | Boyadjieff | |
| 5,253,710 | A | 10/1993 | Carter et al. | |
| 5,442,965 | A | 8/1995 | Halen | |
| 5,735,348 | A | 4/1998 | Hawkins, III | |
| 5,850,877 | A | 12/1998 | Albright et al. | |
| 5,918,673 | A | 7/1999 | Hawkins et al. | |
| 6,000,472 | A | 12/1999 | Albright et al. | |
| 6,142,545 | A | 11/2000 | Penman et al. | |

(Continued)

FOREIGN PATENT DOCUMENTS

CA 1239634 7/1988

(Continued)

OTHER PUBLICATIONS

750 Ton AC Top Drive TDS-8S, brochure, Varco Drilling Systems, date unknown.

(Continued)

*Primary Examiner* — Kenneth L Thompson
(74) *Attorney, Agent, or Firm* — Osha Liang LLP

(57) ABSTRACT

A method for running a tubular string in wellbore operations according to one or more aspects of the present disclosure includes providing a tubular running tool comprising gripping assembly rotationally connected to a carrier, the gripping assembly comprising a body and slips; connecting the carrier to a quill of a top drive of a drilling rig; positioning an end of a tubular for gripping with the slips; actuating the slips into gripping engagement with the tubular; and rotating the tubular with the slips in gripping engagement therewith.

31 Claims, 4 Drawing Sheets

U.S. PATENT DOCUMENTS

| | | | | |
|---|---|---|---|---|
| 6,279,654 | B1 | 8/2001 | Mosing et al. | |
| 6,309,002 | B1 | 10/2001 | Bouligny | |
| 6,431,626 | B1 | 8/2002 | Bouligny | |
| 6,595,288 | B2 | 7/2003 | Mosing et al. | |
| 6,634,259 | B2 | 10/2003 | Castille | |
| 6,742,584 | B1 | 6/2004 | Appleton | |
| 6,915,868 | B1 | 7/2005 | Mosing | |
| 7,096,948 | B2 | 8/2006 | Mosing et al. | |
| 7,140,443 | B2 | 11/2006 | Beierbach et al. | |
| 7,325,610 | B2 | 2/2008 | Giroux | |
| 7,503,394 | B2 | 3/2009 | Bouligny | |
| 2003/0173073 | A1* | 9/2003 | Snider et al. | 166/78.1 |
| 2004/0216924 | A1 | 11/2004 | Pietras et al. | |
| 2005/0000691 | A1* | 1/2005 | Giroux et al. | 166/291 |
| 2006/0000600 | A1 | 1/2006 | Pietras | |
| 2006/0118293 | A1 | 6/2006 | Juhasz et al. | |
| 2006/0124293 | A1 | 6/2006 | Juhasz et al. | |
| 2006/0225891 | A1 | 10/2006 | Adams et al. | |
| 2007/0074876 | A1 | 4/2007 | Pietras | |
| 2008/0060818 | A1 | 3/2008 | Bourgeois et al. | |
| 2008/0099196 | A1 | 5/2008 | Latiolais et al. | |

FOREIGN PATENT DOCUMENTS

| | | |
|---|---|---|
| EP | 0171144 | 2/1986 |
| GB | 2347441 | 6/2000 |

OTHER PUBLICATIONS

500 Ton AC Top Drive TDS-11S, brochure, Varco Drilling Systems, date unknown.

Casing Drive System, Tesco, Bulletin 41000e, date unknown.

PCT/US2009/061742; International Search Report and Written Opinion mailed Dec. 14, 2009.

Office action in EP Patent Application No. 10154443.5-1266, dated Apr. 8, 2011 (5 pages).

PCT Notification Concerning Transmittal of International Preliminary Report on Patentability and Written Opinion issued in PCT Application No. PCT/US2009/061742 mailed on May 5, 2011, 7 pages.

Canadian Office Action in reference to Canadian Application No. 2,741,532, dated Aug. 21, 2012 (2 pages).

* cited by examiner

EXTERNAL GRIP TUBULAR RUNNING TOOL

RELATED APPLICATIONS

This application claims the benefit of priority to U.S. Provisional Patent Application No. 61/107,565 filed on Oct. 22, 2008. This application is a continuation-in-part application of U.S. Ser. No. 12/126,072, entitled Adjustable Pipe Guide for Use with an Elevator and/or Spider, filed on May 23, 2008, which is a continuation-in-part of U.S. Ser. No. 11/846,169, entitled Segmented Bottom Guide for String Elevator Assembly, filed on Aug. 28, 2007.

BACKGROUND

This section provides background information to facilitate a better understanding of the various aspects of the present invention. It should be understood that the statements in this section of this document are to be read in this light, and not as admissions of prior art.

A string of wellbore tubulars (e.g., pipe, casing, drillpipe, etc.) may weigh hundreds of thousands of pounds. Despite this significant weight, the tubular string must be carefully controlled as tubular segments are connected and the string is lowered into the wellbore and as tubular segments are disconnected and the tubular string is raised and removed from the wellbore. Fluidicly (e.g., hydraulic and/or pneumatic) actuated tools, such as elevator slips and spider slips, are commonly used to make-up and run the tubular string into the wellbore and to break the tubular string and raise it from the wellbore. The elevator (e.g., string elevator) is carried by the traveling block and moves vertically relative to the spider which is mounted at the drill floor (e.g., rotary table). Fluidic (e.g., hydraulic and/or pneumatic) control equipment is provided to operate the slips in the elevator and/or in the spider. Examples of fluidically actuated slip assemblies (e.g., elevator slip assemblies and spider slip assemblies) and controls are disclosed for example in U.S. Pat. No. 5,909,768 which is incorporated herein by reference; and U.S. Pat. Appl. Pub. Nos. 2009/0056930 and 2009/0057032 of which this application is a continuation-in-part.

The tubular string it typically constructed of tubular segments which are connected by threading together. Traditionally, the top segment (e.g., add-on tubular) relative to the wellbore is stabbed into a box end connection of the tubular string which is supported in the wellbore by the spider. It is noted that the pin and box end may be unitary portions of the tubular segments (e.g., drillpipe) or may be provided by a connector (e.g., casing) which is commonly connected to one end of each tubular prior to running operations. In many operations, the threaded connection is then made-up or broken utilizing tools such as spinners, tongs and wrenches. One style of devices for making and breaking wellbore tubular strings includes a frame that supports up to three power wrenches and a power spinner each aligned vertically with respect to each other. Examples of such devices are disclosed in U.S. Pat. No. 6,634,259 which is incorporated herein by reference. Examples of some internal grip tubular running devices are disclosed in U.S. Pat. No. 6,309,002 and No. 6,431,626, which are incorporated herein by reference.

The tubular segments may be transported to and from the rig floor and alignment with the wellbore by various means including without limitation, cables and drawworks, pipe racking devices, and single joint manipulators. An example of a single joint manipulator arm (e.g., elevator) is disclosed in U.S. Pat. Appl. Publ. No. 2008/0060818, which is incorporated herein by reference. The disclosed manipulator is mounted to a sub positioned between the top drive and the tubular running device. A sub mounted manipulator (e.g., single arm, double arm, etc.) may be utilized with the device of the present disclosure.

It may be desired to fill (e.g., fill-up and/or circulate) the tubular string with a fluid (e.g., drilling fluid, mud) in particular when running the tubular string into the wellbore. In some operations it may be desired to perform cementing operations when running tubular strings, in particular casing strings. Examples of some fill-up devices and cementing devices are disclosed in U.S. Pat. Nos. 7,096,948; 6,595,288; 6,279,654; 5,918,673 and 5,735,348, all of which are incorporated herein by reference.

Tubular strings are often tapered, meaning that the outside diameter (OD) of the tubular segments differ along the length of the tubular string, e.g., have at least one outside diameter transition. Generally the larger diameter tubular sections are placed at the top of the wellbore and the smaller size at the bottom of the wellbore, although a tubular string may include transitions having the larger OD section positioned below the smaller OD section. Running tapered tubular strings typically requires that specifically sized pipe-handling tools (e.g., elevators, spiders, tongs, etc.) must be available on-site for each tubular pipe size. In some cases, the tubular, in particular casing, may have a relatively thin wall that can be crushed if excess force is applied further complicating the process of running tubular strings.

It is a desire, according to one or more aspects of the present disclosure, to provide a method and device for running a tapered tubular string into and/or out of a wellbore. It is a further desire, according to one or more aspects of the present disclosure, to provide a method and device that facilitates filling a tubular string with fluid during a tubular running operation.

SUMMARY

A tubular running tool according to one or more aspects of the present disclosure includes a carrier connected to traveling block of a drilling rig; a body having a tapered surface, the body rotationally connected to the carrier; slips moveably disposed along the tapered surface for selectively gripping a tubular; and a rotational device connected to the slips, the rotational device selectively rotating the slips and gripped tubular relative to the carrier.

A method for running a tubular string in wellbore operations according to one or more aspects of the present disclosure includes providing a tubular running tool comprising gripping assembly rotationally connected to a carrier, the gripping assembly comprising a body and slips; connecting the carrier to a quill of a top drive of a drilling rig; positioning an end of a tubular for gripping with the slips; actuating the slips into gripping engagement with the tubular; and rotating the tubular with the slips in gripping engagement therewith.

According to one or more aspects of the present disclosure, a method for running a tubular string with at least one outer diameter transition into a wellbore includes suspending a tubular running device from a drilling rig, the tubular running device comprising a carrier, a body forming a bowl, the body rotationally connected to the carrier, slips moveably disposed in the bowl, an actuator for at least one of raising and lowering the slips relative to the bowl, and a rotational actuator for selectively rotating the slips; gripping a tubular string with a spider to suspend the tubular string in the wellbore, the tubular string having a first outside diameter; gripping a first add-on tubular with the slips of the tubular running device, the add-on tubular having a first outside diameter; threadedly connecting the add-on tubular to the tubular string; releasing the grip of the spider on the tubular string and suspending the tubular string in the wellbore from the tubular running device; lowering the tubular string into the wellbore by lowering the tubular running device toward the spider; engaging the spider into gripping engagement of the tubular string; releasing the tubular running device from the tubular string; gripping a second add-on tubular with the tubular running device, the second add-on tubular gripped at a location thereof having a second outside diameter different from the first outside diameter of the tubular string; and threadedly connecting the add-on tubular to the tubular string.

The foregoing has outlined some features and technical advantages of the present disclosure in order that the detailed description that follows may be better understood. Additional features and advantages will be described hereinafter which form the subject of the claims of the invention.

BRIEF DESCRIPTION OF THE DRAWINGS

The present disclosure is best understood from the following detailed description when read with the accompanying figures. It is emphasized that, in accordance with standard practice in the industry, various features are not drawn to scale. In fact, the dimensions of various features may be arbitrarily increased or reduced for clarity of discussion.

DETAILED DESCRIPTION

Figure 1:
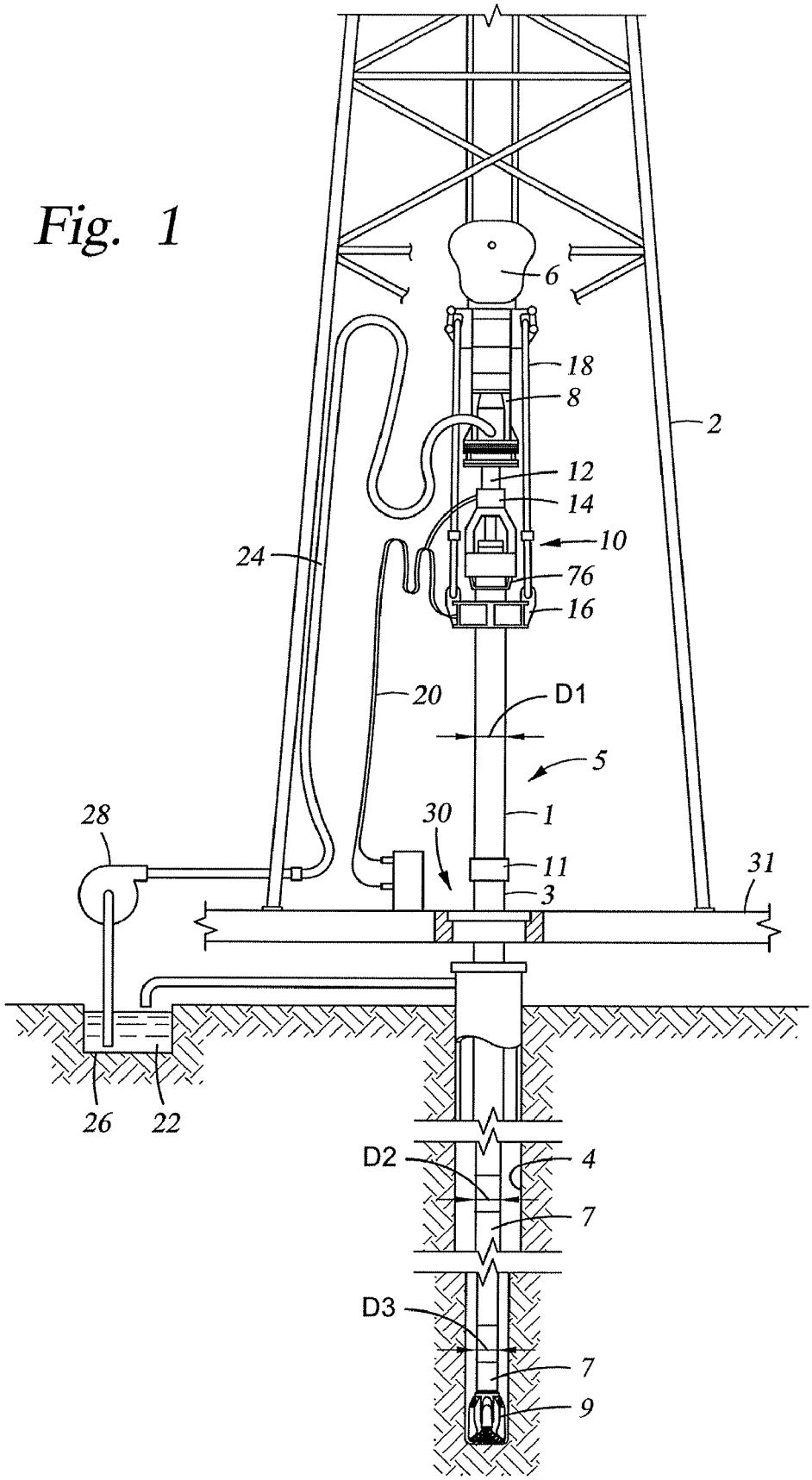
FIG. 1 is a schematic view of an apparatus and system according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

As used herein, the terms "up" and "down"; "upper" and "lower"; "top" and "bottom"; and other like terms indicating relative positions to a given point or element are utilized to more clearly describe some elements. Commonly, these terms relate to a reference point as the surface from which drilling operations are initiated as being the top point and the total depth of the well being the lowest point, wherein the well (e.g., wellbore, borehole) is vertical, horizontal or slanted relative to the surface. The terms "pipe," "tubular," "tubular member," "casing," "liner," tubing," "drillpipe," "drillstring" and other like terms can be used interchangeably.

In this disclosure, "fluidically coupled" or "fluidically connected" and similar terms (e.g., hydraulically, pneumatically), may be used to describe bodies that are connected in such a way that fluid pressure may be transmitted between and among the connected items. The term "in fluid communication" is used to describe bodies that are connected in such a way that fluid can flow between and among the connected items. Fluidically coupled may include certain arrangements where fluid may not flow between the items, but the fluid pressure may nonetheless be transmitted. Thus, fluid communication is a subset of fluidically coupled.

The present disclosure relates in particular to devices, systems and methods for making and/or breaking tubular strings and/or running tubular strings. For example devices, systems and methods for applying torque to a tubular segment and/or tubular string, gripping and suspending tubular segments and/or tubular strings (e.g., lifting and/or lowering), and rotating (e.g., rotating while reciprocating) tubular segments and/or tubular strings. According to one or more aspects of the present disclosure, a tubular gripping tool may include fill-up, circulating, and/or cementing functionality.

FIG. 1 is a schematic view of a tubular running device, generally denoted by the numeral 10, according to one or more aspects of the present disclosure being utilized in a wellbore tubular running operation. Tubular running device (e.g., tool) 10 is suspended from a structure 2 (e.g., rig, drilling rig, etc.) above a wellbore 4 by a traveling block 6. In the depicted embodiment, tubular running device 10 is connected to a top drive 8 which includes a rotational motor (e.g., pneumatic, electric, hydraulic). Top drive 8 is suspended from traveling block 6 for vertical movement relative to wellbore 4. Top drive 8 may be connected with guide rails. According to one or more aspects of the present disclosure, tubular running device 10 may be suspended from bails 18 or the like which may be suspended by traveling block 6 and/or top drive 8.

Depicted device 10 is connected to top drive 8 via quill 12 (e.g., drive shaft) which includes a bore for disposing fluid (e.g., drilling fluid, mud). In this embodiment, device 10 also comprises a thread compensator 14. Thread compensator 14 may be threadedly connected between quill 12 and device 10, e.g., carrier 34 thereof. Additionally or alternatively, device 10 can be connected (e.g., supported) from bails 18, e.g., in an embodiment where the quill is not utilized to rotate device 10. Thread compensator 14 may provide vertical movement (e.g., compensation) associated with the travel distance of the add-on tubular when it is being threadedly connected to or disconnected from the tubular string. Examples of thread compensators include fluidic actuators (e.g., cylinders) and biased (e.g., spring) devices. For example, the thread compensator may permit vertical movement of the connected device 10 in response to the downward force and movement of add-on tubular 7*a* as it is threadedly connected to tubular string 5. One example of a thread compensator is disclosed in Ser. No. 12/414,645, which is incorporated herein by reference.

Tubular running device 10 is depicted supporting a string 5 of interconnected tubular segments generally denoted by the numeral 7. The upper most or top tubular segment is referred to as the add-on tubular, denoted in FIG. 1 by call-out 7*a*. The lower end 1 (e.g., pin end, distal end relative to traveling block 6) of add-on tubular 7*a* is depicted disposed with the top end 3 (e.g., box end) of the top tubular segment of tubular string 5. Tubular string 5 is disposed through support device 30 (e.g., spider slip assembly i.e., spider) disposed at floor 31. Spider 31 is operable to grip and suspend tubular string 5 in wellbore 4 for example while add-on tubular 7*a* is being connected to or disconnected from tubular string 5.

In FIG. 1, add-on tubular 7*a* is depicted threadedly connected to tubular string 5 at threaded connection 11. For purposes of description, threaded connection 11 is depicted to illustrate a box connection, e.g., proximal end of a drillpipe or an internally threaded collar which may be utilized when connecting casing segments for example. Depicted tubular string 5 is a tapered tubular string which has at least one outer diameter transition, e.g., different outside diameters of the body of the tubular itself along its length. For example, tubular string 5 depicted in FIG. 1 comprises add-on tubular 7*a* having an outside diameter D1 connected to a section of string 5 having an outside diameter D2 which is connected to a section of string 5 that has an outside diameter D3. Although two outer diameter transitions are depicted in FIG. 1, tool 10 may be used to run a single or greater than two outer diameter transitions. In one embodiment, the outer diameters refer to the body of the tubular itself, and not a differing OD connector portion thereof. Optional drill bit 9 is depicted connected to the bottom end of tubular string 5 in FIG. 1. According to one or more aspects of the present disclosure, tubular running device 10 may be utilized while drilling (or reaming) a portion of wellbore 4 with a drill bit (or reamer, etc.).

A single joint elevator 16 is depicted in FIG. 1 suspended from bails 18 (e.g., link arms which can be actuated, e.g., actuated to a non-vertical position to pick up pipe from a V-door of a rig) and traveling block 6 to illustrate at least one example of a means for transporting add-on tubular 7*a* to and from general alignment (e.g., staging area) with wellbore 4, e.g., for gripping the tubular at the top end 3 (e.g., proximal) via tubular running device 10. Bails 18, and thus elevator 16, may be connected to traveling block 6, top drive 8, tubular running device 10, and/or other non-rotating devices (e.g., subs etc.) intervening traveling block 6 and tubular running device 10. For example, elevator 16 and actuatable link arms may be connected to a sub type member connected between traveling block 6 and/or top drive 8 and tubular running device 10. In some embodiments, elevator 16 may be suspended for example on bails (e.g., actuatable members) from traveling block 6 or top drive 8. Tubular running device 10 may include a pipe guide 76 positioned proximate to the bottom end of carrier 34 oriented toward spider 30 to guide the top end 3 of add-on tubular 7*a* and/or the top end of tubular string 5 into tubular running device 10. Pipe guide 76 may be adjustable to grip a range of outside diameter tubular segments, such as disclosed in U.S. Pat. Appl. Pub. Nos. 2009/0056930 and 2009/0057032 of which this application is a continuation-in-part.

Power and operational communication may be provided to tubular running device 10 and/or other operating systems via lines 20. For example, pressurized fluid (e.g., hydraulic, pneumatic) and/or electricity may be provided to power and/or control one or more devices, e.g., actuators. In the depicted system, a fluid 22 (e.g., drilling fluid, mud, cement, liquid, gas) may be provided to tubular string 5 via mud line 24. Mud line 24 is generically depicted extending from a reservoir 26 (e.g., tank, pit) of fluid 22 via pump 28 and into tubular string 5 via device 10 (e.g., fluidic connector, fill-up device, etc.). Fluid 22 may be introduced to device 10 and add-on tubular 7*a* and tubular string 5 in various manners including through a bore extending from top drive 8 and the devices intervening the connection of the top drive to device 10 as well as introduced radially into the section/devices intervening the connection of top drive 8 and device 10. For example, rotary swivel unions may be utilized to provide fluid connections for fluidic power and/or control lines 20 and/or mud line 24. Swivel unions may be adapted so that the inner member rotates for example through a connection to the rotating quill. Swivel unions may be obtained from various sources including Dynamic Sealing Technologies located at Andover, Minn., USA (www.sealingdynamics.com). Swivel unions may be used in one or more locations to provide relative movement between and/or across a device in addition to providing a mechanism for attaching and or routing fluidic line and/or electric lines.

Figure 2:
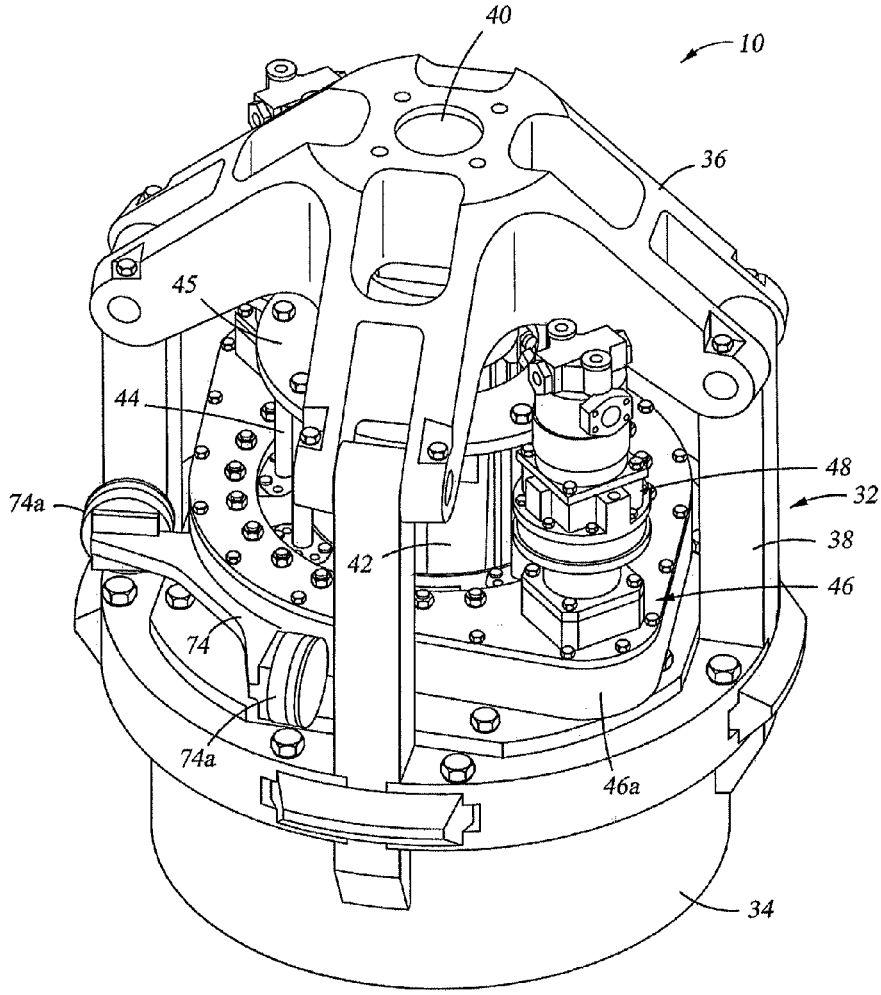
FIG. 2 is a schematic, perspective view of a tubular running device according to one or more aspects of the present disclosure.
Figure 3:
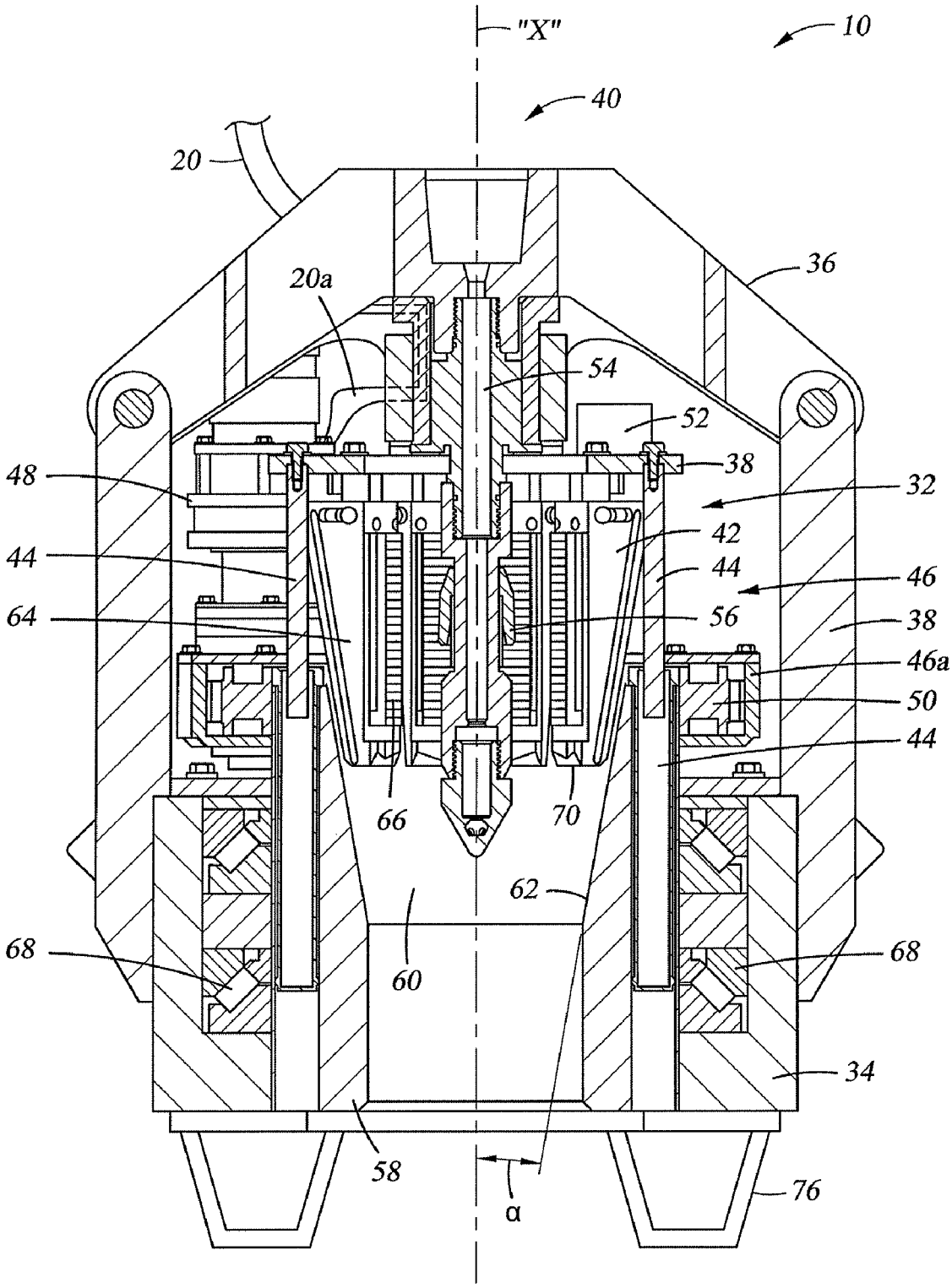
FIG. 3 is a schematic, cut-away view of tubular running device according to one or more aspects of the present disclosure.

FIG. 2 is a schematic view of a tubular running device 10 according to one or more aspects of the present disclosure. Depicted device 10 comprises a gripping assembly 32 disposed with a carrier 34. Carrier 34 includes an upper member 36 and arms 38. A passage 40 is depicted formed through upper member 36. Passage 40 may provide access for disposing and/or connecting top drive 8 (e.g., quill 12 thereof). Passage 40 can be threaded, e.g., internally threaded, to connect quill 12 for example. Top drive 8 via quill 12, subs, and the like may be connected to carrier 34 via top member 36 by threading for example. Referring to FIG. 3, a rotary swivel union 72 is depicted connecting lines 20 to device 10, for example to provide fluidic power and/or control to the actuators that are connected with the slips and which rotate with the slips.

Gripping assembly 32 includes slips 42 and actuators 44. Although multiple actuators are depicted, a single actuator may be used to power the slips up and/or down relative to bowl 60. According to one or more aspects, actuators 44 may be hydraulic or pneumatic actuators to raise and/or lower slips 42 relative to bowl 60 (FIG. 3). In the depicted embodiment, gripping assembly 32 comprises more than one slip 42. Slip 42 may include tubular gripping surface, e.g., only one or two columns of gripping dies. A timing ring 45 may be connected to slips 42 to facilitate setting slips 42 at substantially the same vertical position relative to one another in the bowl and/or relative to the gripped tubular. Although bowl 60 is depicted as having a continuous surface 62 therein, a "bowl" having a discontinuous surface, e.g., gaps between where a slip contacts the "bowl" surface, may be used.

Figure 4:
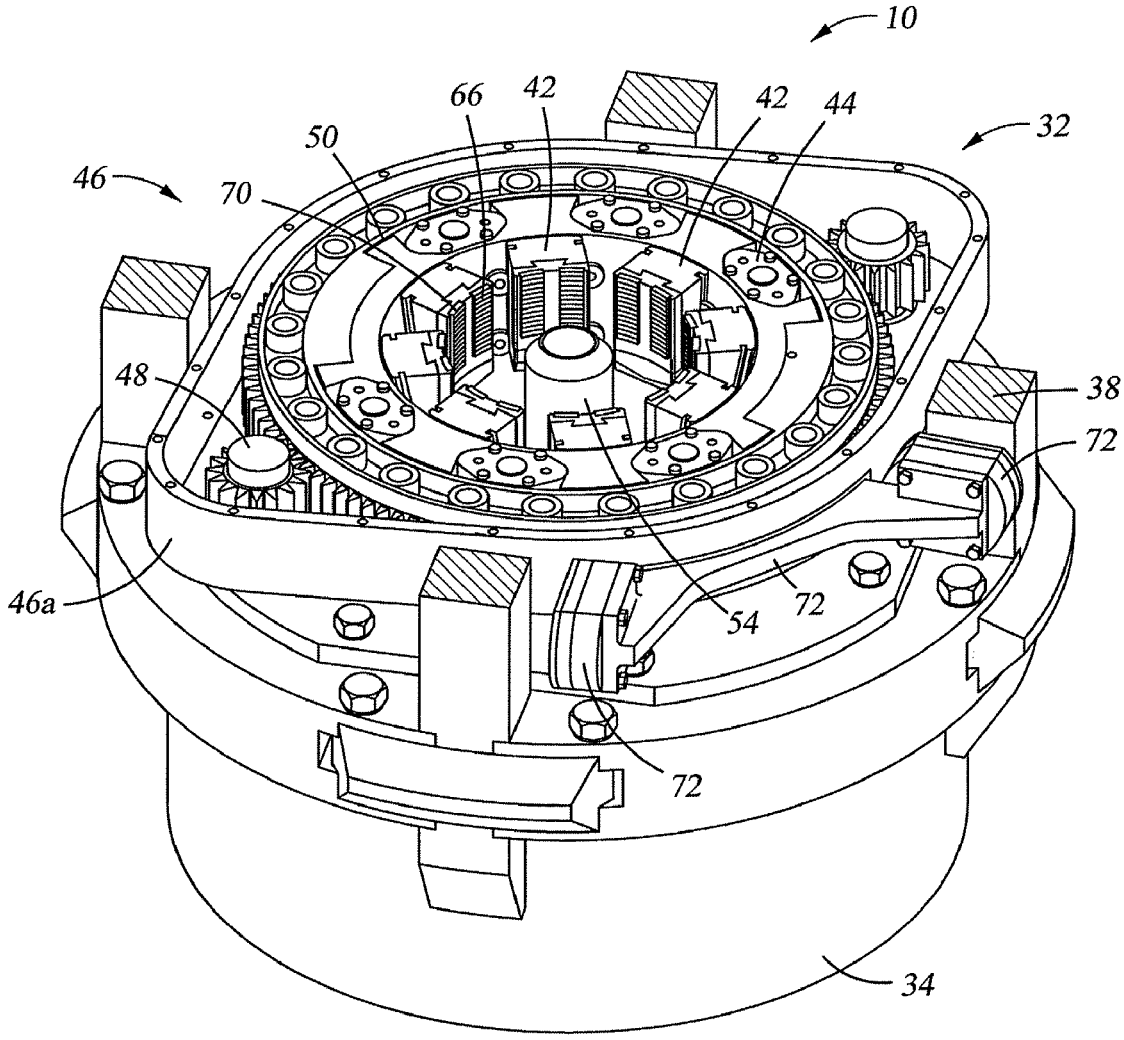
FIG. 4 is a sectional top view of a tubular running device according to one or more aspects of the present disclosure.

A rotational driver 46, carried with running device 10, is connected to gripping assembly 32. For example, rotational driver 46 is connected to slips 42 via bowl 60 (FIG. 3). As will be further understood, rotation may be provided to the gripped tubular via gripping assembly 32 via top drive 8 and/or rotational driver 46. In one embodiment, rotational driver 46 includes an actuator 48, for example, a motor (e.g., electric, hydraulic, pneumatic) and may include a driver assembly 50, such as, and without limitation to, the spur gears illustrated in FIG. 4. Utilization of rotational driver 46 may minimize the rotational mass that would be seen, e.g., by top drive 8 by reducing the number of components rotating relative to the structure 2 (e.g., rig). In one embodiment, rotational driver 46 may be used to rotate the gripped tubular (e.g., to make up and/or break out a threaded connection and/or to rotate a casing joint and/or casing string). For example, top drive quill 12 may be locked into a substantially non-rotating position and used to react the torque generated by rotational driver 46 and allow relative rotation of the gripped tubular (e.g., add-on tubular 7*a* and/or string 5 of FIG. 1) via gripping assembly 32 (e.g., body 58, slips 42, bowl 60) relative to carrier 34. In one embodiment, one of rotational driver 46 and top drive 8 may be utilized to make and break threaded connections 11 (FIG. 1) and the other utilized to rotate tubular string 5 (FIG. 1). For example, rotational driver 46 may be actuated to make-up the threaded connection between the add-on tubular and the tubular string and the top drive may be actuated to rotate the connected tubular string or vice versa. In the embodiments depicted in FIGS. 2 and 4, a reaction member 74 is connected to rotational driver 46 (e.g., rotational driver housing 46*a*) to react the torque generated by rotational driver 46. For example, rotational driver 46 is depicted disposed with body 58 and connected to gripping assembly 32 at body 58 and drive assembly 50 (e.g., gears, belt, etc.). Reaction member 74, depicted in FIGS. 2 and 4, is connected to rotational driver 46 (e.g., at housing 46*a*). When rotational driver 46 is actuated, actuator 48 moves drive assembly 50 which is connected to body 58. Rotation of rotational driver 46 relative to carrier 34 is stopped by reaction member 74 contacting carrier 34 (e.g., arms 38) in the depicted embodiment and the torque is reacted to gripping assembly 32 and the gripped tubular, rotating the gripped tubular and gripping assembly 32 relative to carrier 34. Reaction member 74 may comprise a load cell(s) 74*a* to measuring the torque being applied to the gripped tubular. Reaction member 74 may include two load cells for example to measure the force applied in a clockwise rotation and/or in a counter-clockwise rotation. A single load cell 74*a* may be also be used to measure the torque applied in either direction. In another embodiment, top drive 8 is rotated to rotate the tubular gripped by gripping assembly 32. In this example, carrier 34 is rotated by the rotation of top drive 8. With rotational driver 46 locked (or removed but with the gripping assembly 32 connected to reaction member 74 to restrict rotation therebetween), the rotation and torque applied to carrier 34 by top drive 8 is reacted to gripping assembly 32, for example by reaction member 74. In this example, carrier 34, gripping assembly 32, and the gripped tubular rotate in unison. Again, reaction member 74 may include a load cell or other device for measuring the torque applied to the gripped tubular.

Various other devices, sensors and the like may be included although not described in detail herein. For example, a pipe end sensor 52 schematically depicted in FIG. 2 may be provided to detect the presence of the tubular in device 10. Pipe end sensor 52 may be utilized to prevent the engagement of slips 42 until the end of the tubular is present. An example of a pipe end sensor is disclosed in U.S. Pub. Appl. No. 2003/0145984 which is incorporated herein by reference.

FIG. 3 is a sectional schematic of a tubular running device 10 according to one or more aspects of the present disclosure. FIG. 3 depicts a sectional view of device 10 along longitudinal axis "X". In this embodiment a fluidic device 54 (e.g., stinger, fill-up device, etc.) is depicted for providing fluid into the add-on tubular and/or tubular string. Referring to FIG. 1, fluidic device 54 provides a fluidic connection of fluid 22 from reservoir 26 into add-on tubular 7*a* and tubular string 5. The depicted fluidic connector 54 includes a seal 56 (e.g., packer cup) for sealing in add-on tubular 7*a*. Fluidic device 54 is depicted connected with carrier 34 (e.g., top member 36) and swivel union 72. In the depicted embodiment, fluidic device 54 is connected to carrier 34 (at top member 36) and it is stationary relative to carrier 34 and top drive 8 (e.g., quill 12) in configuration depicted in FIG. 1. In other words, when top drive is not rotating (e.g., quill 12 is locked) then carrier 34 is stationary relative to quill 12. Swivel union 72 provides one mechanism for routing fluidic pressure, for example via lines 20 (FIG. 1), to actuators 44 which rotate with slips 42. In the depicted example, a fluid line 20 is connected to inner sleeve 72*a* of swivel union 72 and is discharged through the outer (rotating) sleeve 72*b* of swivel union 72 to actuator 44. Other mechanisms including fluid reservoirs and the like may be utilized to provide the energy necessary to operate actuators 44 for example. The fluidic device may be extendable, for example telescopic, for selectively extending in length. Fluid 22, including without limitation drilling mud and cement, may be provided. Device 10 and passage 40 may be adapted for performing cementing operations and may include a remotely launchable cementing plug, e.g., attached to a distal end (e.g., distal relative to device 10) of fluidic device 54.

Referring to FIGS. 2 and 3 in particular, gripping assembly 32 includes a body 58 forming bowl 60 in which tubular (e.g., add-on tubular 7*a*) is disposed and slips 42 are translated into and out of engagement with the disposed tubular. Depicted bowl 60 is defined by a conical surface 62 rotated about longitudinal axis "X". In the illustrated embodiment, surface 62 is a smooth surface and is referred to herein as a tapered (e.g., straight tapered) surface. A straight tapered bowl 60 facilitates utilizing tubular running device 10 for running a tapered tubular string 5 (FIG. 1) wherein the tubular string has different outside diameters along its length. However, in some embodiments, surface 62 may be stepped, e.g., to allow rapid advance or retraction of slips 42. In a stepped configuration, surface 62 may have multiple surface portions that extend toward and away from axis "X".

Depicted surface 62 mates with the outer surface 64 of slips 42 to move slips 42 toward and away from axis "X" when slips 42 are translated vertically along longitudinal axis "X" (e.g., by actuators 44 and/or timing ring 45). Each slip 42, e.g., all slips, may be retained along a radial line extending from the longitudinal axis "X" of the device 10 for example via timing ring 45. For example, and with reference to FIG. 3, the slips are movable between a tubular engaged position and a tubular disengaged position. Timing ring 45 may be actuated downward against surface 62 (e.g., bowl 60) via actuators 44 moving into body 58 to engage slips 42 against the tubular that is disposed in bowl 60. Surface 62 extends at an angle alpha ($\alpha$) from vertical as illustrated by longitudinal axis "X". Slips 42 include gripping surface, e.g., elements 66 (e.g., dies) which may be arranged in die columns. Depicted slips 42 include gripping elements 66 arranged in die columns on the face 70 of slips 42 opposite surface 64. Depicted slips 42 include two columns of gripping elements 66. Slips 42 can include a single column of gripping elements. It is suggested that slips with three or more columns of gripping elements do not conform to the tubular as well as slips that have one or two columns, in particular if the tubular is over or undersized. It is also suggested that slips 42 that have three or more columns of gripping elements do not grip out-of-round tubular segments as well as single or double columns. Gripping elements 66 may be unitary to slips 42 or may be separate die members connected to slips 42. Device may include any number of slips 42 (e.g., slip assemblies), e.g., 6, 8, 10, 12, 14, 16, 18 or more, or any range therebetween. In FIG. 4, device 10 includes eight slips 42.

Body 58 is connected to traveling block 6 and/or top drive 8 (FIG. 1) via carrier 34. In the embodiment depicted in FIG. 3, bearings 68 connect body 58 and carriage 34 facilitating the rotational movement of body 58 and slips 42 relative to carrier 34. Depicted bearings 68 are dual bearings that facilitate using device 10 to push and pull (e.g., via traveling block 6) the gripped tubular (e.g., add-on tubular 7*a* and/or tubular string 5), although a single or a plurality of bearings, e.g., thrust bearing, can be used without departing from the spirit of the invention.

Rotational drive assembly 50 (e.g., gears, belt, etc.) is depicted as connected to body 58 (e.g., gripping assembly 32) in FIG. 3. Actuation of the rotational driver, e.g., actuator 48, rotates driver assembly 50 and gripping assembly 32 relative to carrier 34. Rotational driver 46 (e.g., driver housing 46*a*) may be fixedly connected to carrier 34 (e.g., stationary relative to carrier 34). If driver housing 46*a* is fixedly connected (not shown in the Figures) to carrier 34, torque generated by rotational driver 46 (e.g., actuator 48 and driver assembly 50) is reacted into carrier 34 which is connected to traveling block 6 (e.g., via quill 12 of top drive 8).

FIG. 4 is a schematic, sectional top view of tubular running device 10 revealing portions of gripping assembly 32. The view depicts fluidic connector 54 disposed substantially centered between slips 42. Drive assembly 50 as noted with reference to FIG. 2 is also revealed.

According to one or more aspects of the present disclosure, a method for running a tapered tubular string into a wellbore is now described with reference to FIGS. 1-4. The method comprises suspending a running device 10 from a drilling rig 2. Running device 10 may comprise a carrier 34, a body 58 forming a bowl 60 rotationally connected to carrier 34, slips 42 moveably disposed in bowl 60, an actuator 44 for raising and/or lowering slips 42 relative to bowl 60, and a rotational driver 46 for selectively rotating slips 42 (e.g., gripping assembly 32 relative to carrier 34). Tubular string 5 is gripped with a supporting device 30, e.g., spider, suspending tubular string 5 in wellbore 4, tubular string 5 having a first outside diameter D2 section. A first add-on tubular may be transferred to the wellbore. A top, or proximal, end of the first add-on tubular is disposed into bowl 60, for example through pipe guide 76 (e.g., an adjustable pipe guide). Gripping the first add-on tubular with slips 42 of running device 10, the first add-on tubular has a first outside diameter D2; threadedly connecting the add-on tubular 7*a* to the tubular string 5; releasing the grip of the spider on the tubular string, suspending the tubular string in the wellbore from running device 10; lowering tubular string 5 into the wellbore by lowering running device 10 toward spider 30; engaging the spider, gripping tubular string 5; releasing running device 10 from the tubular string 5. A second add-on tubular having a second diameter D1 may than be added to the tubular string without changing tubular running device 10, body 58, or slips 42 to run the tubular with the second outside diameter that is different from the outside diameter of the first tubular. The second add-on tubular, having a second diameter D1 different from the first diameter D2 of the first add-on tubular is stabbed into bowl 60 (e.g., through pipe guide 76) and gripped by tubular running device 10 (e.g., slips 42). Actuator(s) 44 are operated to lower slips 42 against surface 62 until gripping members 66 are engaging the disposed tubular. The second add-on tubular is rotated via device 10 threadedly connecting the second add-on tubular to the tubular string. The process is repeated until the desired length of tubular string is positioned in the wellbore. All or part of the tubular string may be cemented in the wellbore utilizing tubular running tool 5. The steps of threadedly connecting the add-on tubulars to the tubular string may comprise actuating the rotational driver 46 to rotate the gripped tubular and or actuating the top drive to rotated the running device and the gripped tubular. Similarly, the tubing string (when disengaged from the spider) may be rotated via top drive 8 a running tool 10 and/or by actuating rotational driver actuator 48 to rotate the tubular string gripped by the gripping assembly (e.g., relative to carrier 34).

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure. The scope of the invention should be determined only by the language of the claims that follow. The term "comprising" within the claims is intended to mean "including at least" such that the recited listing of elements in a claim are an open group. The terms "a," "an" and other singular terms are intended to include the plural forms thereof unless specifically excluded.

What is claimed is:

1. A tubular running tool, the tubular running tool comprising:

a carrier connected to traveling block of a drilling rig;

a body having a tapered surface, the body rotationally connected to the carrier;

slips moveably disposed along the tapered surface for selectively gripping a tubular;

the slips moveable to a first engaged position with respect to the tapered surface of the body such that the slips grip the tubular at a first outer diameter thereof; and the slips moveable to a second engaged position with respect to the tapered surface of the body such that the slips grip a second tubular at a second outer diameter thereof substantially different from the first outer diameter; and a rotational device connected to the slips, the rotational device selectively rotating the slips and gripped tubular relative to the carrier.

2. The tubular running tool of claim 1, further comprising an actuator selectively moving the slips relative to the tapered surface.

3. The tubular running tool of claim 1, wherein the carrier is connectable to a quill of a top drive connected to the traveling block of the drilling rig.

4. The tubular running tool of claim 1, wherein the slips comprise gripping elements extending from a surface directed away from the tapered surface.

5. The tubular running tool of claim 4, wherein each slip comprises a single column of gripping elements.

6. The tubular running tool of claim 4, wherein each slip comprises only two columns of gripping elements.

7. The tubular running tool of claim 1, further comprising a fill-up device to fluidically connect to the bore of the tubular.

8. The tubular running tool of claim 1, further comprising a thread compensator disposed between the slips and the traveling block.

9. The tubular running tool of claim 1, wherein the rotational device comprises an actuator and drive assembly supported by the carrier.

10. The tubular running tool of claim 1, further comprising a reaction member connected to a rotational driver to react the torque generated by the rotational driver to the carrier.

11. The tubular running tool of claim 1, wherein the tapered surfaces is formed on a bowl formed by the body.

12. The tubular running tool of claim 1, further comprising a pipe guide connected to the carrier proximate to the bowl.

13. A tubular running tool, the tubular running tool comprising:

a carrier connected to traveling block of a drilling rig;

a body having a tapered surface, the body rotationally connected to the carrier;

slips moveably disposed along the tapered surface for selectively gripping a tubular;

a rotational device connected to the slips, the rotational device selectively rotating the slips and gripped tubular relative to the carrier; and a reaction member connected to a rotational driver to react the torque generated by the rotational driver to the carrier;

wherein the reaction member comprises a load cell for measuring the torque applied from the rotational driver.

14. A method for running a tubular string in wellbore operations, the method comprising the steps of:

providing a tubular running tool comprising gripping assembly rotationally connected to a carrier, the gripping assembly comprising a body and slips;

connecting the carrier to a quill of a top drive of a drilling rig;

positioning an end of a tubular for gripping with the slips;

actuating the slips into gripping engagement with the tubular such that the slips grip the tubular at a first outer diameter thereof;

rotating the tubular with the slips in gripping engagement therewith;

releasing the slips from gripping engagement with the tubular;

positioning an end of a second tubular for gripping with the slips; and actuating the slips into gripping engagement with the second tubular such that the slips grip the second tubular at a second outer diameter thereof substantially different from the first outer diameter.

15. The method of claim 14, wherein the step of rotating the tubular comprises rotating the top drive to rotate the connected carrier and the gripping assembly.

16. The method of claim 15, further comprising the step of holding the gripping assembly rotationally stationary with the carrier.

17. The method of claim 14, wherein the body comprises a bowl and the slips are moveable relative to the bowl.

18. The method of claim 14, wherein:

the body comprises a bowl; and the step of positioning an end of a tubular for gripping comprises positioning the end of the tubular for gripping into the bowl.

19. The method of claim 14, wherein the step of rotating the tubular comprises actuating a rotational driver disposed with the carrier to rotate the gripping assembly relative to the carrier; and further comprising:

measuring the torque applied to the gripping assembly from the rotational driver via a reaction member connecting the carrier and the rotational driver.

20. A method for running a tubular string in wellbore operations, the method comprising the steps of:

providing a tubular running tool comprising gripping assembly rotationally connected to a carrier, the gripping assembly comprising a body and slips;

connecting the carrier to a quill of a top drive of a drilling rig;

positioning an end of a tubular for gripping with the slips;

actuating the slips into gripping engagement with the tubular; and rotating the tubular with the slips in gripping engagement therewith;

wherein the step of rotating the tubular comprises rotating the gripping assembly relative to the carrier.

21. A method for running a tubular string in wellbore operations, the method comprising the steps of:

providing a tubular running tool comprising gripping assembly rotationally connected to a carrier, the gripping assembly comprising a body and slips;

connecting the carrier to a quill of a top drive of a drilling rig;

positioning an end of a tubular for gripping with the slips;

actuating the slips into gripping engagement with the tubular; and rotating the tubular with the slips in gripping engagement therewith;

wherein the step of rotating the tubular comprises actuating a rotational driver disposed with the carrier to rotate the gripping assembly relative to the carrier.

22. A method for running a tubular string in wellbore operations, the method comprising the steps of:

providing a tubular running tool comprising gripping assembly rotationally connected to a carrier, the gripping assembly comprising a body and slips;

connecting the carrier to a quill of a top drive of a drilling rig;

positioning an end of a tubular for gripping with the slips;

actuating the slips into gripping engagement with the tubular;

rotating the tubular with the slips in gripping engagement therewith;

wherein the body comprises a bowl; and the step of positioning an end of a tubular for gripping comprises positioning the end of the tubular for gripping through a pipe guide into the bowl.

23. A method for running a tubular string in wellbore operations, the method comprising the steps of:

providing a tubular running tool comprising gripping assembly rotationally connected to a carrier, the gripping assembly comprising a body and slips;

connecting the carrier to a quill of a top drive of a drilling rig;

positioning an end of a tubular for gripping with the slips;

actuating the slips into gripping engagement with the tubular;

rotating the tubular with the slips in gripping engagement therewith; and measuring the torque applied in to rotate the tubular.

24. A method for running a tubular string in wellbore operations, the method comprising the steps of:

providing a tubular running tool comprising gripping assembly rotationally connected to a carrier, the gripping assembly comprising a body and slips;

connecting the carrier to a quill of a top drive of a drilling rig;

positioning an end of a tubular for gripping with the slips;

actuating the slips into gripping engagement with the tubular;

rotating the tubular with the slips in gripping engagement therewith;

wherein the step of rotating the tubular comprises actuating a rotational driver disposed with the carrier to rotate the gripping assembly relative to the carrier; and measuring the torque applied to the gripping assembly from the rotational driver.

25. A method for running a tubular string with at least one outer diameter transition into a wellbore, the method comprising:

suspending a tubular running device from a drilling rig, the tubular running device comprising a carrier, a body forming a bowl, the body rotationally connected to the carrier, slips moveably disposed in the bowl, an actuator for at least one of raising and lowering the slips relative to the bowl, and a rotational actuator for selectively rotating the slips;

gripping a tubular string with a spider to suspend the tubular string in the wellbore, the tubular string having a first outside diameter;

gripping a first add-on tubular with the slips of the tubular running device, the add-on tubular having a first outside diameter;

threadedly connecting the add-on tubular to the tubular string;

releasing the grip of the spider on the tubular string and suspending the tubular string in the wellbore from the tubular running device;

lowering the tubular string into the wellbore by lowering the tubular running device toward the spider;

engaging the spider into gripping engagement of the tubular string;

releasing the tubular running device from the tubular string;

gripping a second add-on tubular with the tubular running device, the second add-on tubular gripped at a location thereof having a second outside diameter different from the first outside diameter of the tubular string; and threadedly connecting the add-on tubular to the tubular string.

26. The method of claim 25, wherein the step of threadedly connecting comprises rotating the slips by actuating the rotational actuator.

27. The method of claim 25, wherein releasing the tubular running device comprises powering the actuator to raise the slips relative to the bowl.

28. The method of claim 25, further comprising rotating the tubular string with the rotational actuator while the spider is not gripping the tubular string and the tubular string is suspended from the tubular running device.

29. The method of claim 28, wherein rotating the tubular string comprises rotating the slips relative to the carrier.

30. The method of claim 25, further comprising rotating the tubular string with a top drive while the spider is not gripping the tubular string and the tubular string is suspended from the tubular running device.

31. The method of claim 30, wherein rotating the tubular string comprises rotating the top drive, the carrier and the slips.

* * * * *